United States Patent [19]

Erb

[11] Patent Number: 4,703,934

[45] Date of Patent: Nov. 3, 1987

[54] BOARD GAME SIMULATING BOXING

[76] Inventor: John W. Erb, 6877 Beloit, San Diego, Calif. 92111

[21] Appl. No.: 806,525

[22] Filed: Dec. 9, 1985

[51] Int. Cl.[4] ..... A63F 3/00

[52] U.S. Cl. ..... 273/244; 273/282

[58] Field of Search ..... 273/243, 244, 255, 253, 273/146, 249, 248, 262

[56] References Cited

U.S. PATENT DOCUMENTS

| | | | |
|---|---|---|---|
| 1,102,954 | 7/1914 | Ries et al. | 273/244 |
| 1,404,599 | 1/1922 | Glenny | 273/244 |
| 1,558,288 | 10/1925 | Roman | 273/249 |
| 1,713,455 | 5/1929 | Stickney | 273/262 |
| 2,310,686 | 2/1943 | Freer | 273/255 |
| 3,310,308 | 3/1967 | Reagan | 273/244 |
| 3,565,438 | 2/1971 | Bischof | 273/253 |

FOREIGN PATENT DOCUMENTS

| | | | |
|---|---|---|---|
| 744267 | 2/1956 | United Kingdom | 273/244 |

*Primary Examiner*—Richard C. Pinkham
*Assistant Examiner*—Benjamin H. Layno

[57] ABSTRACT

A board game apparatus including a pair of dice and from two to eight pieces of play (boxers). The game board playing area is defined as a twelve by twelve grid of perpendicularly intersecting lines of holes. Some or all of the pieces of play (boxers) are entered into play on the game board's playing area by the players. The pieces of play (boxers) move according to the throw of the dice. One die indicates movement along a grid line and the other die indicates movement along another grid line perpendicular to the first grid line. Thus, the pieces of play move along the game board surface following an "L" move pattern. The players position their pieces of play (boxers) according to the game rules, to eliminate opposing pieces of play (boxers) until only one remains. That remaining one is the winner.

1 Claim, 3 Drawing Figures

BOARD GAME SIMULATING BOXING

BACKGROUND OF THE INVENTION

This invention is based on a historical boxing contest known as 'Battle Royal'. About the turn of the century in the United States, eight boxers, more or less, would enter the ring at one time. The bell would sound and everyone would fight each other until only one man remained on his feet. The first black heavyweight champion, Jack Johnson, received his career impetus through this style of fighting. Thus this invention relates to a game for two through eight players, each of whom controls one or more pieces of play (boxers).

This invention can be used and enjoyed by persons of all ages.

SUMMARY OF THE INVENTION

According to the invention, the game board has, centered within it, a play area (boxing ring) containing one hundred forty four positions in a twelve by twelve grid. Said positions are holes which are interconnected by a grid of inscribed lines. The pieces of play (boxers) are represented by the upper portion of a boxer's body. A dowel protruding downward from the bottom of the boxer's body, allows the boxer to be situated in any hole (selected per the play) in the play area (boxing ring) or when not in play to one of the eight holes outside the play area. Each piece of play (boxer) is identified by a unique color and/or name.

One or more pairs of common dice are used by the players to sequentially position their pieces of play (boxers). The precise utilization of the invention in play will become more apparent from the following detailed description taken in conjunction with the accompanying three drawing figures.

BRIEF DESCRIPTION OF THE DRAWING

In order that the invention may be more readily understood a sample game according to the invention and one set of rules for playing such games will now be described by way of example with reference to the accompanying drawings wherein.

DETAILED DESCRIPTION OF THE PREFERRED EMBODIMENT

Figure 1:
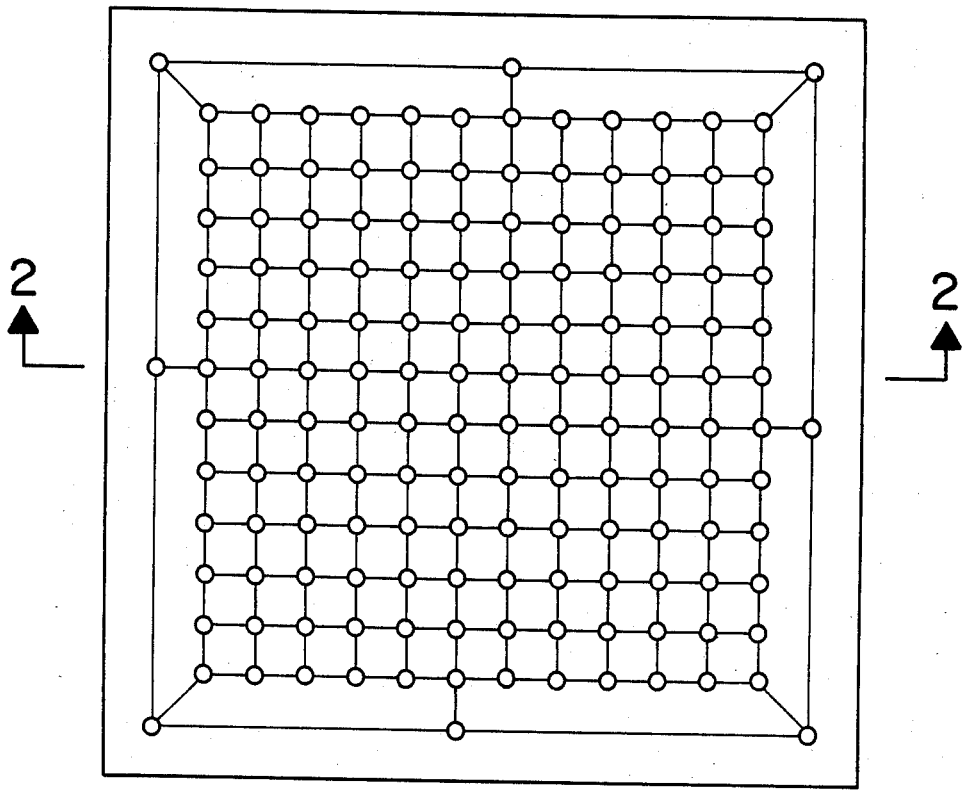
FIG. 1 is a plan view of a board for use in playing the game of the present invention.
Figure 2:
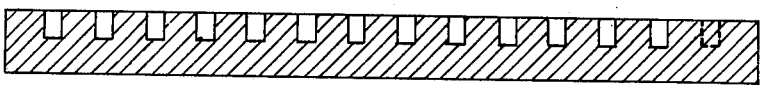
FIG. 2 is a mid-section view of a board for use in playing the game of the present invention.

Referring now to FIG. 1, a square board suitable for playing the present invention is illustrated. Said board has one hundred forty four holes in the playing area (ring) interconnected by inscribed lines in an equilateral grid.

Figure 3:
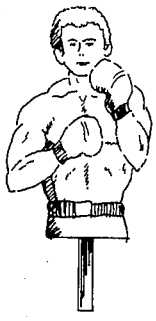
FIG. 3 is a perspective view of a piece of play (boxer) for use in playing the game of the present invention.

Play begins when the players move their pieces of play (boxers, see FIG. 3) from their positions outside the playing area (ring). Each player must initially control an equivalent number of pieces of play (boxers), e.g., two players may each control four boxers. Each player then rolls a pair of dice. The player with the highest sum rolled begins play by rerolling his dice and moving his boxer. The play thence progresses clockwise. The boxers are moved along one of the inscribed lines the number of line intercepts as shown on either one of the dice. From that point the boxer is secondarily moved at right angles from last said inscribed line (either direction chosen and possible), the number of line intercepts as shown on the other die. Thus, with one roll of the dice a player can have up to as many as eight different optional positions to place his/her boxer. If the dice in play allows the player's boxer to land on another boxer; the boxer landed on is eliminated from the game by a knockout. The sole exception is when the boxer landed on occupies any position in the outer line of the ring. In that case the boxer landed on shall suffer a five point penalty. And the boxer landed on shall lay down next to the hole he formerly occupied until his next play. If a player moves his boxer next to an opponent's boxer (i.e. with no hole between them); the opponent's boxer shall suffer a two point penalty. If a player moves his boxer so that only one hole lies between his boxer and the opponent's boxer; the opponent's boxer shall suffer a one point penalty. The accumulation of ten or more penalty points by any boxer immediately puts that boxer out of the game on a T.K.O. The last remaining boxer is the winner.

I claim:

1. The method of playing a game having a game board, a plurality of playing pieces, and a pair of dice, said game board having a symmetrical grid defined by a first set of parallel lines intersecting at right angles a second set of parallel lines, each intersection having a hole therein, each one of said playing pieces being distinguished by a different color and each having a dowel protruding downwardly wherein said dowels are adapted to be received by said holes allowing said playing pieces to be positioned in any of said holes, said method comprising:

a player in turn rolling the dice where either one of said dice indicates the number of holes the player's playing piece can move along one of said lines, moving the playing piece, according to the number appearing on one of said dice, along one of said lines, then after landing on a last hole for that move, moving said playing piece at a right angle along a perpendicular line intersecting the last hole according to the number appearing on the other die, thus, following an "L" shape move pattern, players in turn continuing the rolling of the dice and moving their playing pieces to positions on the game board relative to the position of the opponent's playing pieces, according to the game rules, in an attempt to remove the opponent's playing pieces from the game board.

* * * * *